US010100496B2

(12) United States Patent
Taddia et al.

(10) Patent No.: US 10,100,496 B2
(45) Date of Patent: Oct. 16, 2018

(54) HYDRAULIC SECTION FOR LOAD SENSING APPLICATIONS AND MULTIPLE HYDRAULIC DISTRIBUTOR

(71) Applicant: BUCHER HYDRAULICS S.p.A., Reggio Emilia (IT)

(72) Inventors: Luca Taddia, Modena (IT); Massimo Riva, Modena (IT)

(73) Assignee: BUCHER HYDRAULICS S.P.A., Reggio Emilia (IT)

( * ) Notice: Subject to any disclaimer, the term of this patent is extended or adjusted under 35 U.S.C. 154(b) by 484 days.

(21) Appl. No.: 14/627,136

(22) Filed: Feb. 20, 2015

(65) Prior Publication Data

US 2015/0259887 A1 Sep. 17, 2015

(30) Foreign Application Priority Data

Mar. 11, 2014 (EP) ..... 14158991

(51) Int. Cl.
*F15B 11/05* (2006.01)
*E02F 9/22* (2006.01)
*F15B 13/04* (2006.01)

(52) U.S. Cl.
CPC ..... *E02F 9/2228* (2013.01); *E02F 9/226* (2013.01); *E02F 9/2225* (2013.01); *E02F 9/2267* (2013.01); *F15B 13/0417* (2013.01); *F15B 11/05* (2013.01); *F15B 2211/40553* (2013.01)

(58) Field of Classification Search
CPC ..... F15B 11/05; F15B 2211/40569
See application file for complete search history.

(56) References Cited

U.S. PATENT DOCUMENTS 3,534,774 A 10/1970 Tennis et al.
5,305,789 A * 4/1994 Rivolier ..... F15B 13/0417 137/596
7,395,662 B2 7/2008 Kauss
8,100,145 B2 * 1/2012 Desbois-Renaudin ..... F15B 13/01 137/514.3
2006/0037649 A1 2/2006 Busani
2006/0191582 A1 8/2006 Kauss et al.
2009/0007976 A1 1/2009 Desbois-Renaudin

FOREIGN PATENT DOCUMENTS

DE 19631803 A1 2/1998
DE 102006049584 A1 9/2007
EP 1 164 297 A1 12/2001
EP 1628018 A1 2/2006
GB 2 445 095 A 6/2008
JP H10196607 A 7/1998
(Continued)

*Primary Examiner* — F. Daniel Lopez
(74) *Attorney, Agent, or Firm* — Pearne & Gordon LLP

(57) ABSTRACT

Hydraulic section (1) for use in a hydraulic distributor (10), comprising: a valve body (2); a main spool (3); pressure compensator (5) housed in a first hole in the valve body (2); a piston (11) housed in the first hole; an intermediate chamber (16) in fluid communication with the feed line (Pal), the intermediate chamber (16) extending at least partially in the first hole and being delimited by the rod (12) of the piston (11); two limiters (6, 7) and a drainage channel (18) pertaining to the intermediate chamber (16) for altering the pressure thereof and close the compensator (5).

12 Claims, 9 Drawing Sheets

(56) References Cited

FOREIGN PATENT DOCUMENTS

| | | | |
|---|---|---|---|
| WO | 2004109125 | A1 | 12/2004 |
| WO | 2011/096001 | A1 | 8/2011 |
| WO | 2011/115647 | A1 | 9/2011 |
| WO | 2011/154809 | A1 | 12/2011 |

* cited by examiner

HYDRAULIC SECTION FOR LOAD SENSING APPLICATIONS AND MULTIPLE HYDRAULIC DISTRIBUTOR

The object of the present invention is a hydraulic section for load sensing applications and a multiple hydraulic distributor that uses one or more of these hydraulic sections.

As is known, a load sensing hydraulic system makes it possible to maintain the pressure drop substantially constant through a metering orifice of a spool valve.

In particular, a load sensing hydraulic system finds use in working machines that provide for the simultaneous performance of a plurality of movements. For example, consider the case of a working machine with a rotating turret, such as an excavator or a telescopic loader, in which the rotation of the cabin, the extension of the arm and the movements of the bucket must be managed independently of each other.

In some working machines, for reasons of safety, the movement of one or more hydraulic actuators must be inhibited when dangerous work conditions arise. Again for reasons of safety, it is necessary that some functions be mutually exclusive. For example, when the stabilisers of a crane are activated, all the other functions must be inhibited.

Different manufacturers have proposed a variety of structures for hydraulic distributors that are capable of satisfying this safety requirement.

One solution commonly adopted to ensure safety provides for the use of a logic element for closure in the inlet cover.

As is known, flow-sharing structures have been developed to overcome the limits of conventional structures, in which a request for a flow rate greater than the maximum flow rate that can be delivered by the pump is followed by the slowing down or stopping of the service line having the highest load. On the contrary, flow-sharing distributors provide for a proportional reduction of the flow for all the service lines, when there is a request for a flow rate greater than the maximum deliverable flow that can be supplied by the pump.

Some solutions adopted to satisfy the safety requirement in load sensing distributors of a flow-sharing type are briefly outlined below.

In the solution offered in WO2011/154809, Hydrocontrol solves the safety issue locally, by preventing opening of the compensators by means of a drainage of the frontal chamber.

The solutions proposed by Hitachi and by Rexroth also intervene locally, by preventing the opening of the local compensator (see document EP1164297 by Hitachi and document U.S. Pat. No. 7,395,662 by Rexroth).

Another need regarding working machines is that of limiting the working pressure of several service lines in such a way as to:

reduce energy consumption make a greater flow rate available to the other service lines, thereby increasing the output of the machine.

To achieve these objectives, solutions that avoid the use of auxiliary valves on the workports need to be found, as auxiliary valves discharge the entire flow intended for use at the pre-set pressure value and are thus uneconomical in terms of energy consumption.

Limiting pressure locally is achieved quite easily in conventional load sensing distributors, whereas it proves to be more difficult to achieve in flow-sharing distributors given that the local compensators in the latter share the line for detecting the highest load pressure.

The solution adopted in WO2011/115647 by Parker Hannafin Corporation integrates a pressure limiter in the post-compensator. In practice, this solution is based on piloting the local compensator in the closing direction, by means of a balancing of the pressures on the active areas thereof, and on intervention of the return spring of the same compensator (which is normally closed).

There is further comprised a gauged throttle that enables management of the increase in pressure during the limiting stage, in that it decouples the chamber on the side of the spring with respect to line for detecting the highest load pressure. A drainage line interposed between the active areas prevents undesirable intervention of the limiter.

The principal disadvantage of this solution lies in its highly complex structural design, which also determines difficult access to the contrast spring, with resulting critical problems in the realisation of solutions with adjustable pressures.

In the solution offered by Hitachi (EP1164297), closure of the compensator takes place by means of a dedicated locking/closing valve (indicated in the text as a "lock valve") having two operational positions: a first position that enables the system and a second position that locks the correlated function. By switching from the first to the second position, the valve makes available an output pressure from a generic supply source. Limitation of the pressure is achieved by pilot-shifting the lock/closing valve, which is rendered dependent on the workport pressure.

In document GB2445095, Sauer-Danfoss achieves the limitation of local pressure by discharge draining the front chamber of the post-compensator by means of a specific valve.

Some of the solutions cited above (for example WO2011/115647 and GB2445095) are not suited to priority operation, but only to flow-sharing. For this reason, hydraulic distributors that employ these solutions always require ad hoc designing of flow-sharing and priority sections, which differ in dimensions and circuit logic.

In this context, the technical task underlying the present invention is to offer a hydraulic section for load sensing applications and a multiple hydraulic distributor that overcome the drawbacks of the prior art cited hereinabove.

Specifically, the aim of the present invention is to make available a hydraulic section for load sensing applications with inhibition of the function controlled by the hydraulic section, that is structurally more simple and compact than the prior art solutions and that can be employed universally, that is to say, as a flow-sharing section and as a priority section.

Another aim of the present invention is to offer a hydraulic section for load sensing applications that is capable of locally controlling the maximum working pressure, thereby reducing energy consumption. As mentioned above, the universal nature of the hydraulic section proposed, that is, its use as a flow-sharing section and as a priority section, must be guaranteed.

With reference to the universal nature of a hydraulic section, it is noted that the Applicant has recently developed a hydraulic section that can be employed as a flow-sharing section and as a priority section (see document WO2011/096001). This is made possible by predisposing a channel that passes through all the hydraulic sections and in that the priority sections is connected to a chamber of the pressure compensator, whereas in the flow-sharing sections, it is isolated. More precisely, the second chamber can be connected to the feed line by means of this channel in such a manner that the hydraulic section operates as a priority section, or it can be connected to a line for detecting the highest load pressure so that the section operates as a flow-sharing type of section.

The defined technical task and the specified aims are substantially achieved by a hydraulic section for load sensing applications and by a multiple hydraulic distributor, which comprise the technical characteristics set forth in one or more of the attached claims.

Further characteristics and advantages of the present invention will become clearer from the approximate, and thus non-limiting, description of a preferred, but not exclusive embodiment of a hydraulic section for load sensing applications and a multiple hydraulic distributor, as illustrated in the attached drawings, in which:

FIG. 1 is a sectioned view of a flow-sharing hydraulic section for load sensing applications, according to the present invention;

FIGS. 2*a* and 2*b* are sectioned views of a portion (compensation means and piston) of the hydraulic section appearing in FIG. 1, in a first and second configuration, respectively;

FIG. 3 is a sectioned view of a priority hydraulic section for load sensing applications, according to the present invention;

FIGS. 4*a* and 4*b* are sectioned views of a portion (compensation means and piston) of the hydraulic section appearing in FIG. 3, in a first and second configuration, respectively;

Figure 1:
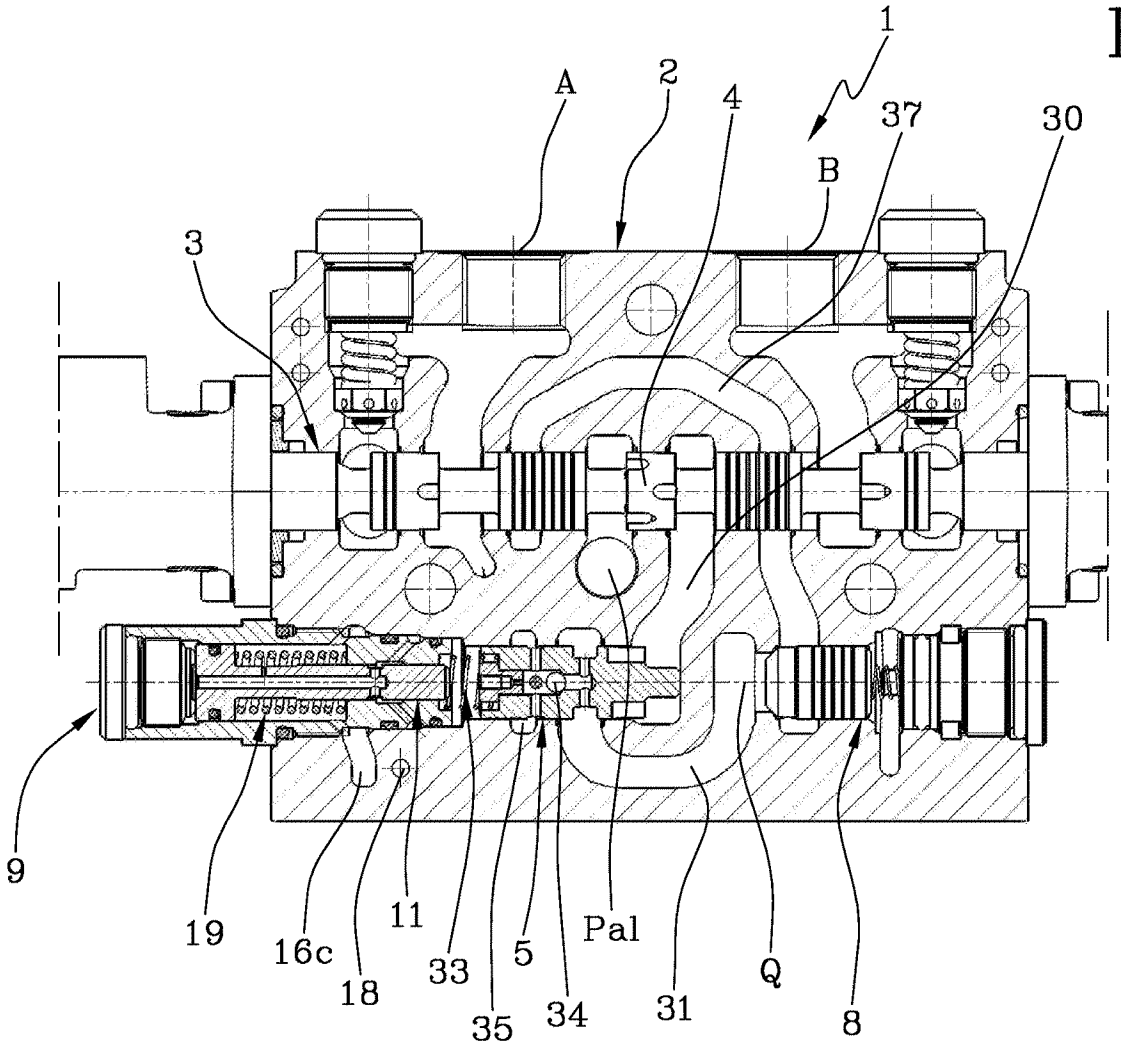

With reference to the figures, a hydraulic section for load sensing applications is indicated by the number 1 and a multiple hydraulic distributor comprising a plurality of hydraulic sections 1 is indicated by the number 10.

Each hydraulic section 1 comprises a valve body 2, inside of which a main spool 3 is longitudinally slidable. This main spool 3 (also known as a "shuttle") serves to selectively transmit pressurised hydraulic fluid coming from a feed line Pal from a pump 100 to workports A, B through a metering orifice 4.

For example, the main spool 3 is of the six-way three-position type. Alternatively, the main spool 3 can be of the four-position type, that is, it comprises an additional position (called the "floating" position) which discharges both workports A, B. Specifically, the main spool 3 is fed by a channel that coincides with the feed line Pal.

Pressure compensation means 5 are found downstream of the main spool 3 and the means 5 are capable of maintaining a substantially constant pressure drop through the metering orifice 4.

The pressure compensation means 5 are housed in a first hole obtained in the valve body 2.

A piston 11 or plunger is housed in the first hole.

As can be seen in FIGS. 2*a*, 2*b*, 4*a* and 4*b*, the piston 11 has a rod 12 that is substantially longitudinal in extension and that originates from a base or bottom 13 with a larger cross-section than the rod 12. In this context, the end of the piston 11 opposite the base 13 is called head 12*a* of the piston 11.

Part of an intermediate chamber 16 that is connectable to the feed line Pal is formed in the first hole, between the rod 12 of the piston 11 and the valve body 2.

Preferably, the piston 11 is enclosed, at least partially, by a liner 20 and can slide therewithin. The intermediate chamber 16 thus has:

- a first zone 16*a* obtained between the rod 12 of the piston 11 and the liner 20;
- a second zone 16*b* obtained in the liner 20;
- a third zone 16*c* obtained in the valve body 2.

In an original manner, there are provided control means 6, 7 that are operatively active on the intermediate chamber 16 so as to alter the pressure thereof in such a manner that the piston 11 forces the compensation means 5 to shift from a first configuration, in which the passage of fluid is enabled and a substantially constant pressure drop is maintained through the metering orifice 4, to a second configuration, in which the passage of fluid is interrupted or limited.

In particular, the hydraulic section 1 comprises at least one drainage channel 18 outflowinq from the intermediate chamber 16.

In the embodiments described and illustrated herein, the control means 6, 7 comprise two limiters 6, 7 integrated in the hydraulic section 1 and piloted by a predefined pressure. For example, this predefined pressure is detected downstream of the compensation means 5 in such a manner as to limit the pressure of the implemented load to a predefined value.

Preferably, these limiters 6, 7 are adjustable.

Alternatively, the control means comprise an external pressure tap that is controlled for example by proportional solenoid valves or by sequence valves, or in any case, devices that are not integrated, but external to the hydraulic section 1.

Preferably, the liner 20 has one open end suitable for receiving a closure plug 9. The piston 11 is interposed between the closure plug 9 and the compensation means 5.

In the embodiments described and illustrated herein, in addition to the intermediate chamber 16 in the first hole, two additional chambers are defined: a rear chamber 14 and a front chamber 15.

The rear chamber 14 is defined between the closure plug 9, the base 13 of the piston 11, and the internal walls of the liner 20.

The front chamber 15 is defined between the compensation means 5, the head 12*a* of the piston 11, the internal walls of the liner 20 and the valve body 2.

The rear chamber 14 is set in communication with the intermediate chamber 16 by means of a passage 17 for fluid obtained in the rod 12 of the piston 11. As stated above, the intermediate chamber 16 is connectable to the feed line Pal and the piston 11 transmits the pressure of the feed line Pal to the rear chamber 14 through the passage 17 for fluid.

In the embodiments described and illustrated herein, the piston 11 is subjected to the action of the pressure on three active areas:

- in the rear chamber 14, the active area is represented by the surface S1 of the base 13;
- in the front chamber 15, the active area is represented by the surface S2 of the head 12*a* of the piston 11;
- in the intermediate chamber 16, the active area is given by the annulus obtained as the difference between the two areas mentioned above, that is, from the difference between the surface S1 of the base 13 and the surface S2 of the head 12*a* of the piston 11.

By action of the control means 6, 7, acting on the intermediate chamber 16, the piston 11 is movable inside the liner 20 between:

- a resting configuration, in which the compensation means 5 are found in the first configuration so that in the intermediate chamber 16 there is a pressure equal to the feed pressure;

an active configuration, in which the compensation means 5 are forced into the second configuration (that is, in the closing direction) so that the pressure in the intermediate chamber 16 is lower than the feed pressure.

Preferably, the passage 17 for fluid obtained in the rod 12 of the piston 11 comprises:

a first portion 17*a* that is substantially longitudinal in extension within the rod 12 and open on the base 13 of the piston 11;

a second portion 17*b* that branches off from the first portion 17*a* and leads into the intermediate chamber 16, particularly in the first zone 16*a* of the intermediate chamber 16.

In particular, the second portion 17*b* extends substantially transversely in the rod 12 of the piston 11.

Preferably, the second portion 17*b* is shaped and dimensioned so as to constitute a throttle.

Preferably, the first portion 17*a* of the passage 17 for fluid is coaxial with the rod 12 of the piston 11.

The passage 17 for fluid comprises two further portions 17*c*, 17*d*, pertaining to the first portion 17*a* and that receive the fluid from the feed line Pa. In particular, the two further portions 17*c*, 17*d* extend substantially transversely in the rod 12 of the piston 11.

In a variant embodiment, a pre-established pressure can be set in the intermediate chamber 16. In this case, the throttle 17*b* is not present. The pre-established pressure is preferably variable.

As can be seen in FIGS. 2*a*, 2*b*, 4*a* and 4*b*, a first spring 19 is housed in the intermediate chamber 16.

In particular, the first spring 19 abuts between the base 13 of the piston 11 and a front portion 20*a* of the liner 20. This first spring 19 allows the piston 11 to remain in the resting configuration until a pressure imbalance occurs due to the discharging of fluid in the drainage channel 18.

Figure 6:
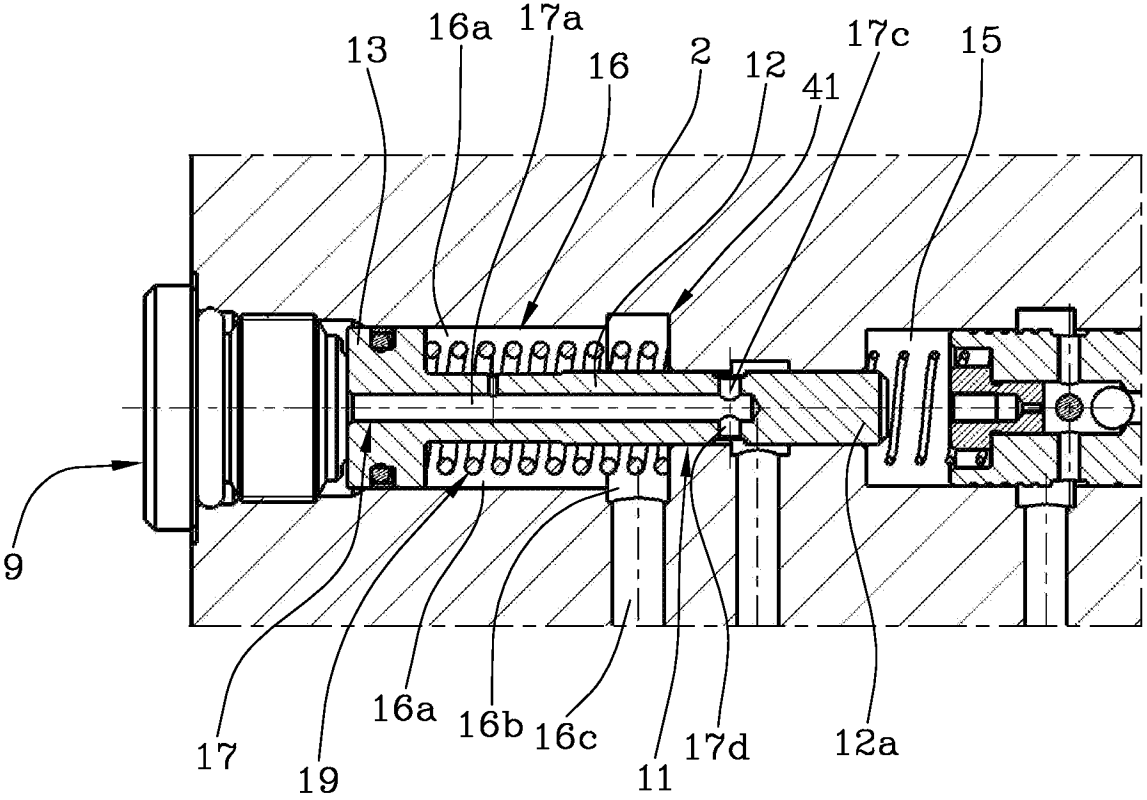
FIG. 6 is a sectioned view of a variant of the portion shown in FIG. 2*a* (compensation means and piston)

In a variant embodiment, which is illustrated in FIG. 6, the piston 11 is housed directly in the first hole, that is the liner 20 is not present. In this case, the valve body 2 is suitably shaped so as to define an abutment element 41 for the first spring 19. In fact, in this case, the first spring 19 abuts between the base 13 of the piston 11 and this abutment element 41 of the valve body 2.

In this variant, the intermediate chamber 16 has:

a first zone 16*a* obtained between the rod 12 of the piston 11 and the valve body 2;

a second zone 16*b* and a third zone 16*c* obtained in the valve body 2.

In this variant, the rear chamber 14 is defined between the closure plug 9, the base 13 of the piston 11 and the walls of the valve body 2 delimiting the first hole.

The front chamber 15 is defined between the compensation means 5, the head 12*a* of the piston 11 and the walls of the valve body 2 delimiting the first hole.

In the hydraulic section 1 appearing in FIG. 1, the compensation means 5 comprises a flow-sharing type of compensator.

In this case, the flow-sharing compensator 5 and the piston 11 are physically separated, that is, they have no mechanical connections. In particular, the front chamber 15, which houses a second spring 33, acts as a separator between the flow-sharing compensator 5 and the piston 11.

The first spring 19 is set with a preload force greater than the value given by the difference between the pressure of the feed line Pal and the line LS for detecting the highest load pressure, multiplied by the surface area S2 of the head 12*a* of the piston 11.

The flow-sharing hydraulic section 1 further comprises retaining means 8, which comprise a load holding unidirectional valve of a known type. The retaining means 8 are housed in a second hole afforded in the valve body 2.

Advantageously, the first hole and the second hole are distinct and fashioned side by side of each other. In particular, both the first and the second hole are substantially longitudinal in extension along a predefined axis Q.

Figure 3:
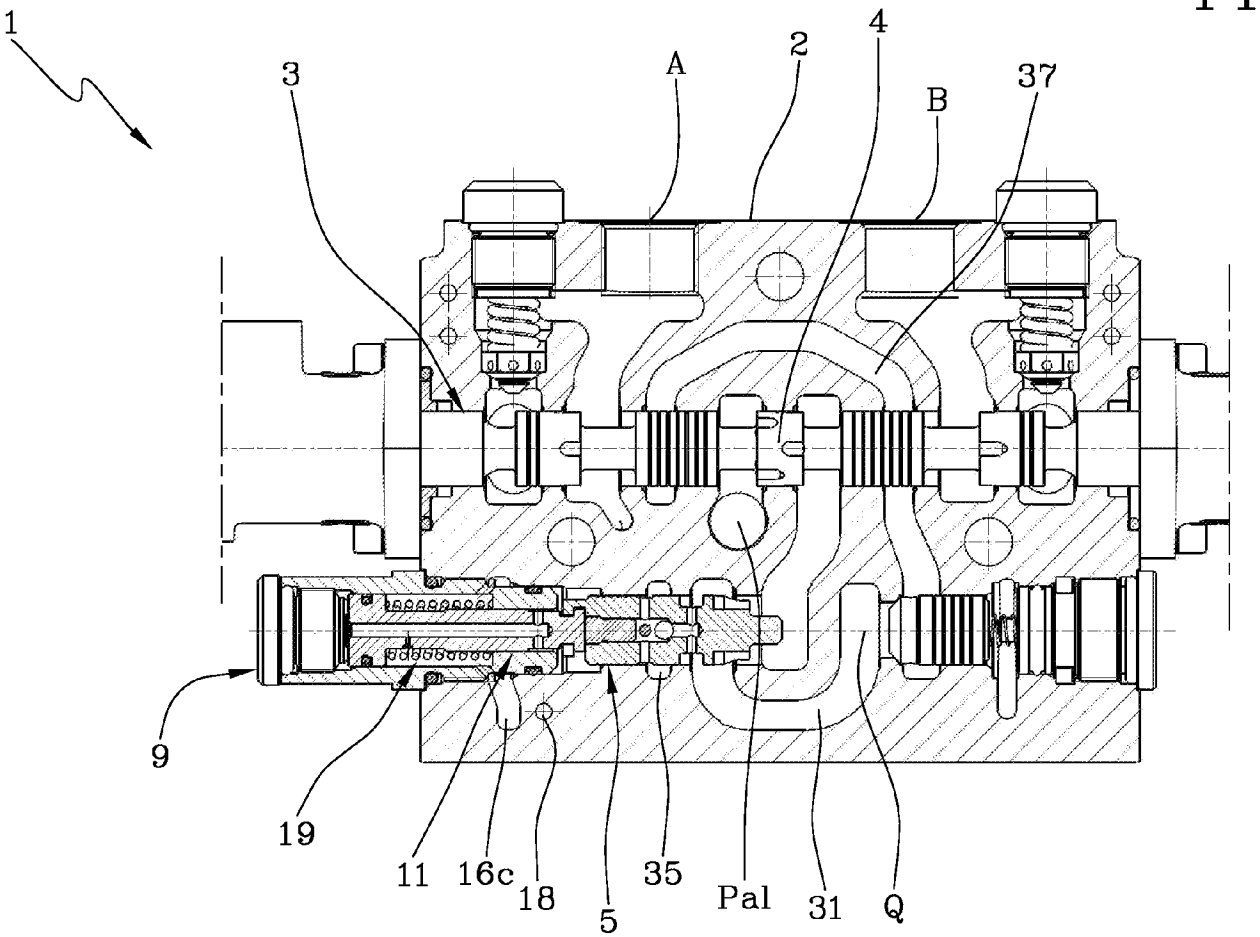

In the hydraulic section 1 appearing in FIG. 3, the compensation means 5 comprises a priority load sensing compensator. In this case, the compensator 5 is mechanically connected to the piston 11.

Preferably, the piston 11 is connected to the compensator 5 by means of a mechanical interlocking element 39. For example, the mechanical interlocking element 39 is of the bayonet type.

Therefore, the second spring 33 is not present.

In addition to the embodiments described and illustrated herein, the pressure compensation means 5 can include:

a check valve, or a flow regulator, or a pre-compensator LS.

The above is a non-exclusive list of examples.

Figure 7:
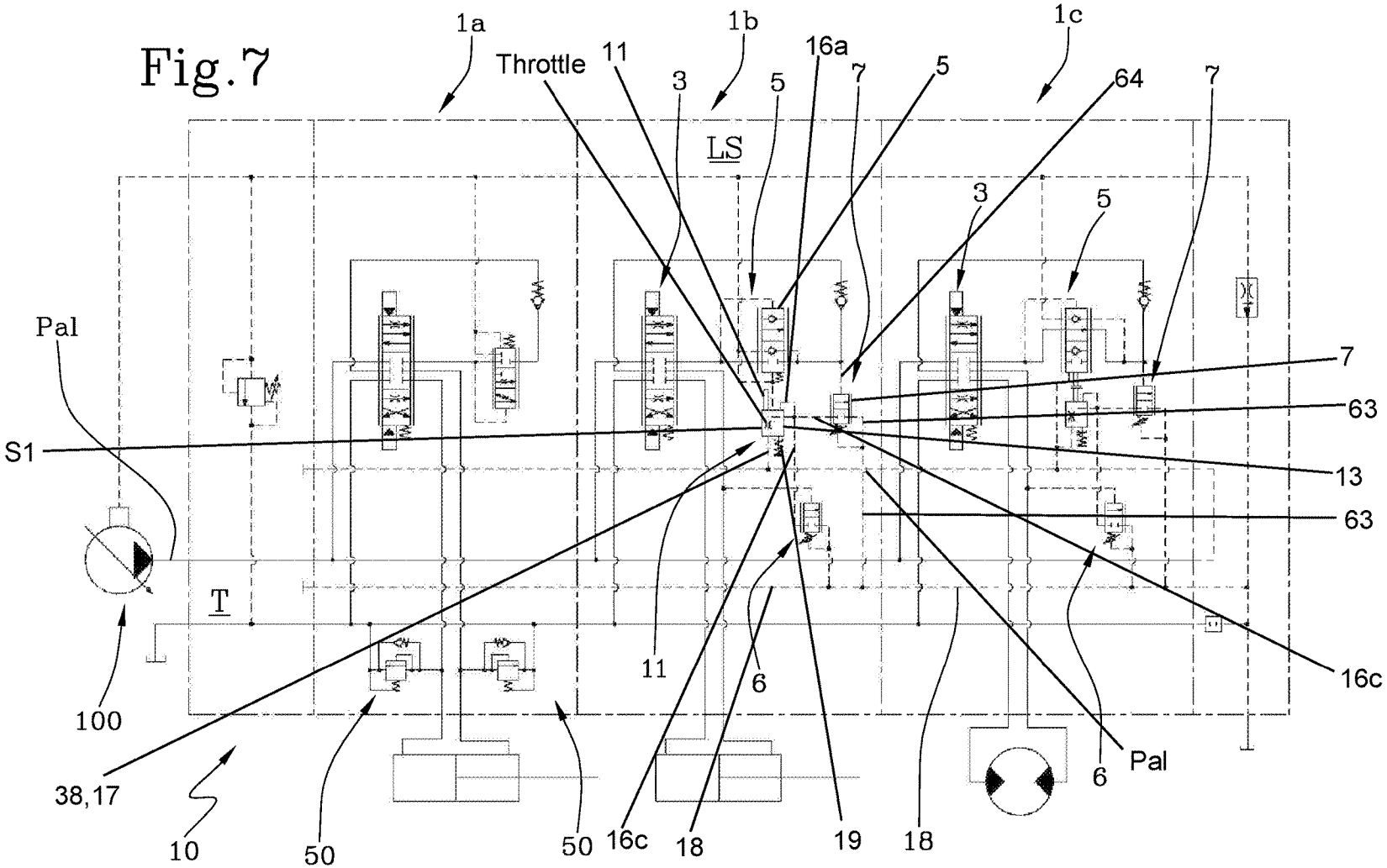
FIG. 7 is the plan of a multiple hydraulic distributor, according to the present invention.

The hydraulic distributor appearing in FIG. 7 comprises a flow-sharing section of a known type, indicated by the number 1*a*, a flow-sharing section according to the invention, indicated by the number 1*b*, and a priority hydraulic section according to the invention, indicated by the number 1*c*.

At least the feed line Pal and a discharge line T pass through all the sections 1*a*, 1*b*, 1*c*. Preferably, the drainage channel 18 also passes through all the sections 1*a*, 1*b* 1*c*.

The flow-sharing section 1*a* of a known type will not be described as it does not constitute the object of the present invention. However, it should be pointed out that in the flow-sharing section 1*a* of a known type, the limiting function is entrusted to auxiliary valves 50 on the workports A, B, with an elevated dissipation of energy.

Figure 5:
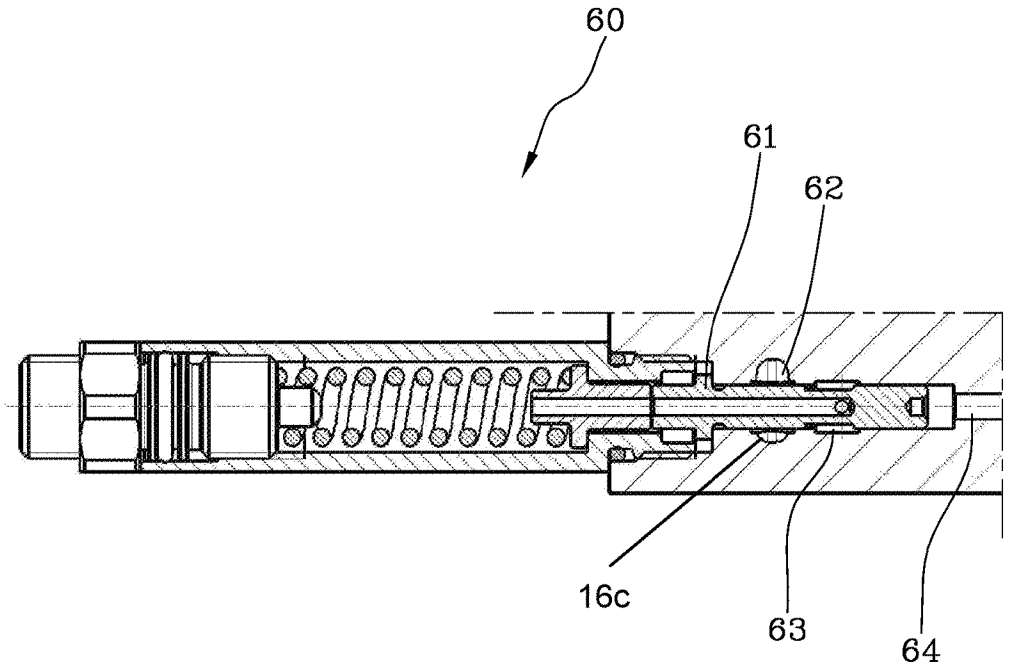
FIG. 5 is a sectioned view of a pilot stage that can be employed in the hydraulic section appearing in FIG. 1 or 3.

The preferred structure of a pilot stage 60 is illustrated in FIG. 5, with a sequence valve, which is employed as a limiter 6, 7.

The pilot stage 60 has a known structural design, the only adaptations consisting in ad hoc dimensioning of the single components for the purpose of integrating them in the hydraulic section 1.

As can be seen in FIG. 5, the pilot stage 60 comprises a pilot spool 61, the movement of which enables the selective communication between a first chamber 62 and a second chamber 63 pertaining to the drainage channel 18. The control pressure present in a front chamber 64 of the pilot spool 61 is preferably taken by the first distributor bridge 31 (defined below). In this case, it is a control pressure, minus losses, that is representative of the pressure detected at the workports A, B.

Alternatively, the pilot spool 61 can be controlled directly with the pressure of the load.

The operation of the proposed hydraulic section is described below. Consider for example the path of the fluid in the flow-sharing hydraulic section appearing in FIG. 1.

The main spool 3 can slide in the valve body 2 between a neutral position, in which it blocks the passage of fluid towards a first chamber 30, and an operational position, in which it enables passage of the pressurised hydraulic fluid coming from the feed line Pal towards the first chamber 30 through the metering orifice 4.

The first chamber 30 represents the front chamber of the flow-sharing pressure compensator 5.

The front chamber 15, which houses the second spring 33, is found on the side opposite the first chamber 30, with respect to the compensator 5.

Overcoming the action of the second spring 33 and that of the pressure present in the front chamber 15, which is permanently connected to the line LS for detecting the highest load pressure, the compensator 5 shifts into the first configuration.

In this state, the fluid passes from the first chamber 30 to a first distributor bridge 31 located downstream of the compensator 5.

Preferably, selective communication between the first bridge 31 and the line LS (communicating with the front chamber 15) takes place by means of a non-return valve 34, for example a ball valve.

From the first distributor bridge 31, passing through the retaining means 8, a second distributor bridge 37, interposed between the retaining means 8 and the main spool 3, is accessed and it delivers the fluid to the workports A, B.

As is known, the function of the retaining means 8 is to inhibit the passage of fluid until the pressure in the first bridge 31 exceeds the pressure in the second distributor bridge 37. Moreover, reverse flow from the workports A, B to the pump 100 is prevented thanks to the retaining means 8.

Preferably, the front chamber 15 is set in communication with an input zone 35 for the signal coming from the line LS for detecting the highest load pressure. Statically, the input zone 35 for the signal LS and the front chamber 15 are subject to the same pressure. Decoupling means 36 capable of dynamically decoupling the input zone 35 from the front chamber 15 are provided. For example, these decoupling means 36 consist of a throttle.

When the pressure compensator 5 is found in the first configuration, the piston 11 is in the resting configuration, so that there is a pressure equal to the feed pressure in the intermediate chamber 16.

In fact, the two further portions 17*c*, 17*d* of the passage 17 for fluid receive the fluid from the feed line Pal through two dedicated channels 38 and they transmit it to the intermediate chamber 16 through the first portion 17*a* and the throttle 17*b*.

Through the same first portion 17*a*, the fluid also reaches the rear chamber 14.

Figure 2A:
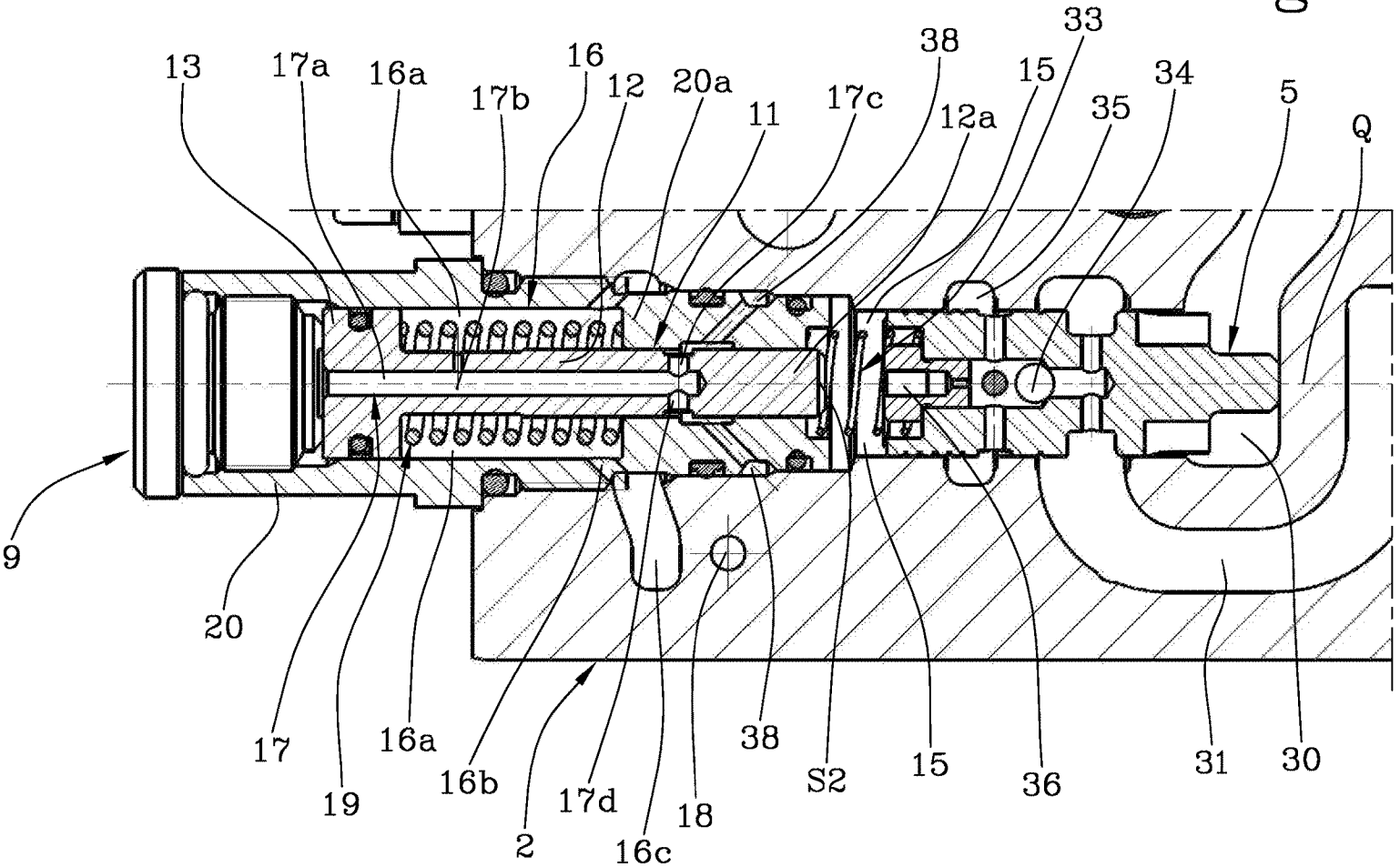

This state is observable in FIG. 2*a*.

In practice, when the piston 11 is in the resting configuration, the pressures involved are as follows:

- pressure coming from the line LS for detecting the highest load pressure acting upon the surface S2 of the head 12*a* of the piston 11 (front chamber 15);
- feed pressure Pal on the annulus defined in the intermediate chamber 16;
- feed pressure Pal on the surface S1 of the base 13 of the piston 11;
- pressure of the first spring 19 (which is pre-loaded).

To inhibit the distribution of fluid to the workports A, B, the pressure in the intermediate chamber 16 is altered by the control means 6, 7.

In particular, the intermediate chamber 16 is partially or completely discharged through the drainage channel 18 pertaining thereto. In this manner, the equilibrium in the active areas on the piston 11 is altered and thus the piston 11 shifts from the resting configuration to the active configuration, forcing the compensator 5 in the closing direction. In this manner, the flow of fluid from the first chamber 30 (or front chamber) to the first distributor bridge 31 is interrupted or limited.

Figure 2B:
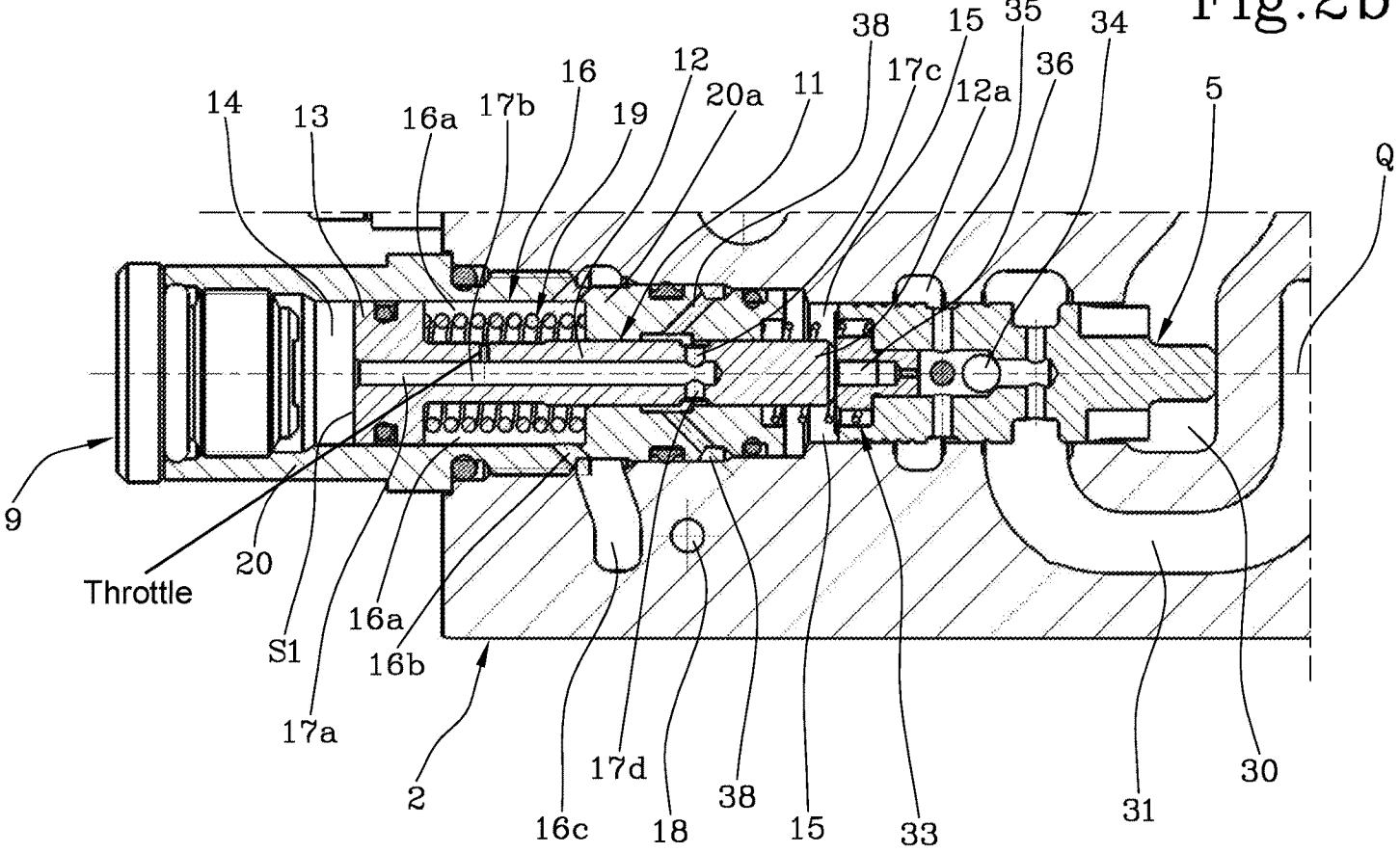

This state is observable in FIG. 2*b*.

The maximum closing force exerted by the piston 11 is obtained by completely discharging the intermediate chamber 16 through the drainage channel 18.

Closure of the pressure compensator 5 is obtained by setting up the piston 11 and the first spring 19 in such a manner that the action of the piston 11 always exceeds than the reaction of the compensator 5.

Partial drainage of the intermediate chamber 16 makes it possible to limit the operating pressure at the workports A, B.

Limitation of the stroke of the piston 11 allows for limitation of the operating flow rate at the workports A, B.

The operation of the priority hydraulic section 1 illustrated in FIG. 3 is similar to that described above, but with differences related to the different structure of the compensation means 5.

In particular, as indicated above, the front chamber 15 does not house any springs (the second spring 33 is not present). However, there is a mechanical interlocking element 39 that connects the piston 11 to the compensator 5.

In this case, all the active areas on the piston 11, including the front chamber 15, receive the feed line Pal pressure.

In fact, the input zone 35 for the signal coming from the line LS for detecting the highest load pressure remains isolated owing to a separator element 40 interposed between the mechanical interlocking element 39 and the compensator 5.

Figure 4A:
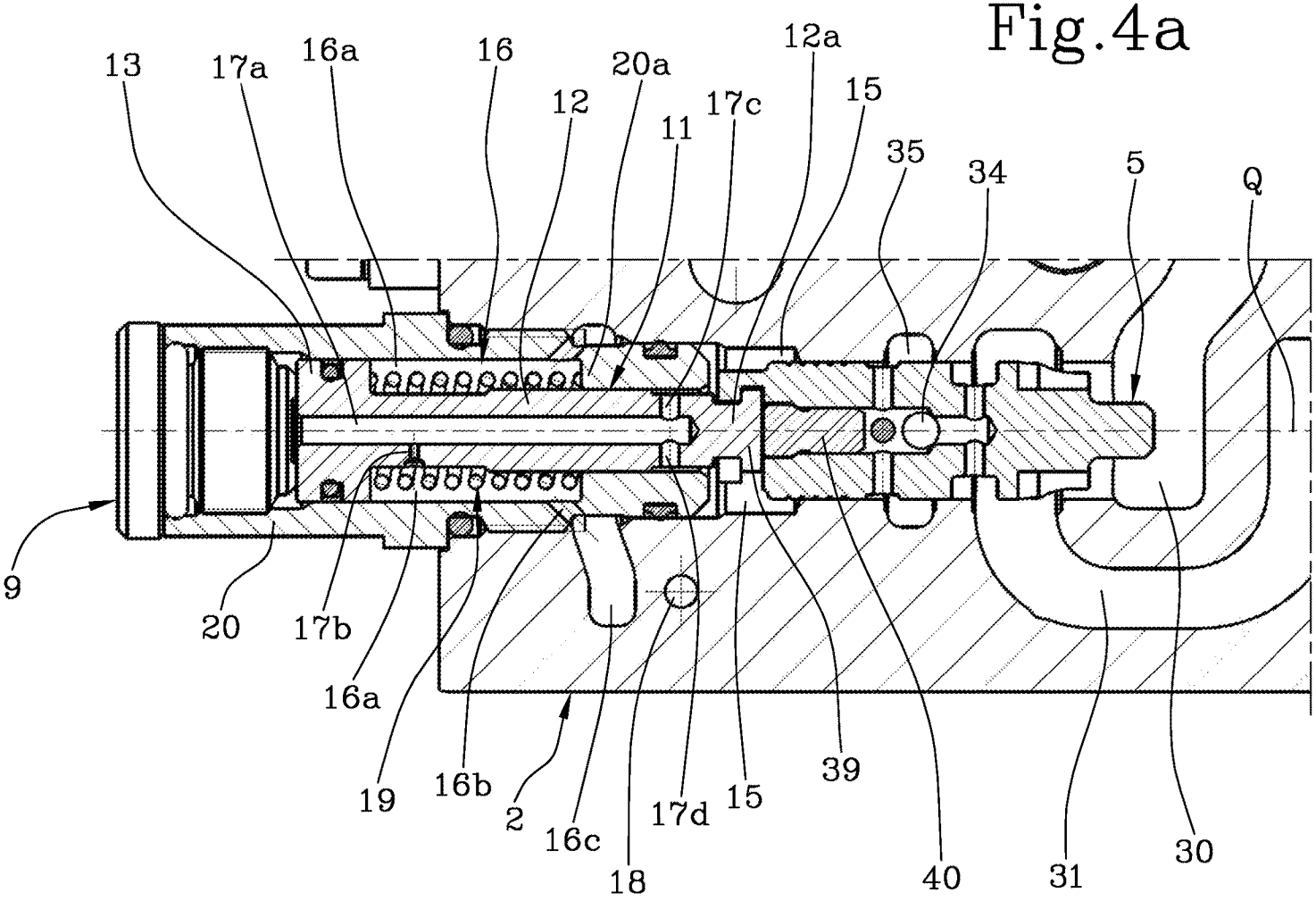

FIG. 4*a* illustrates the situation in which the piston 11 is found in the resting configuration and the compensator 5 is kept in the open configuration.

Figure 4B:
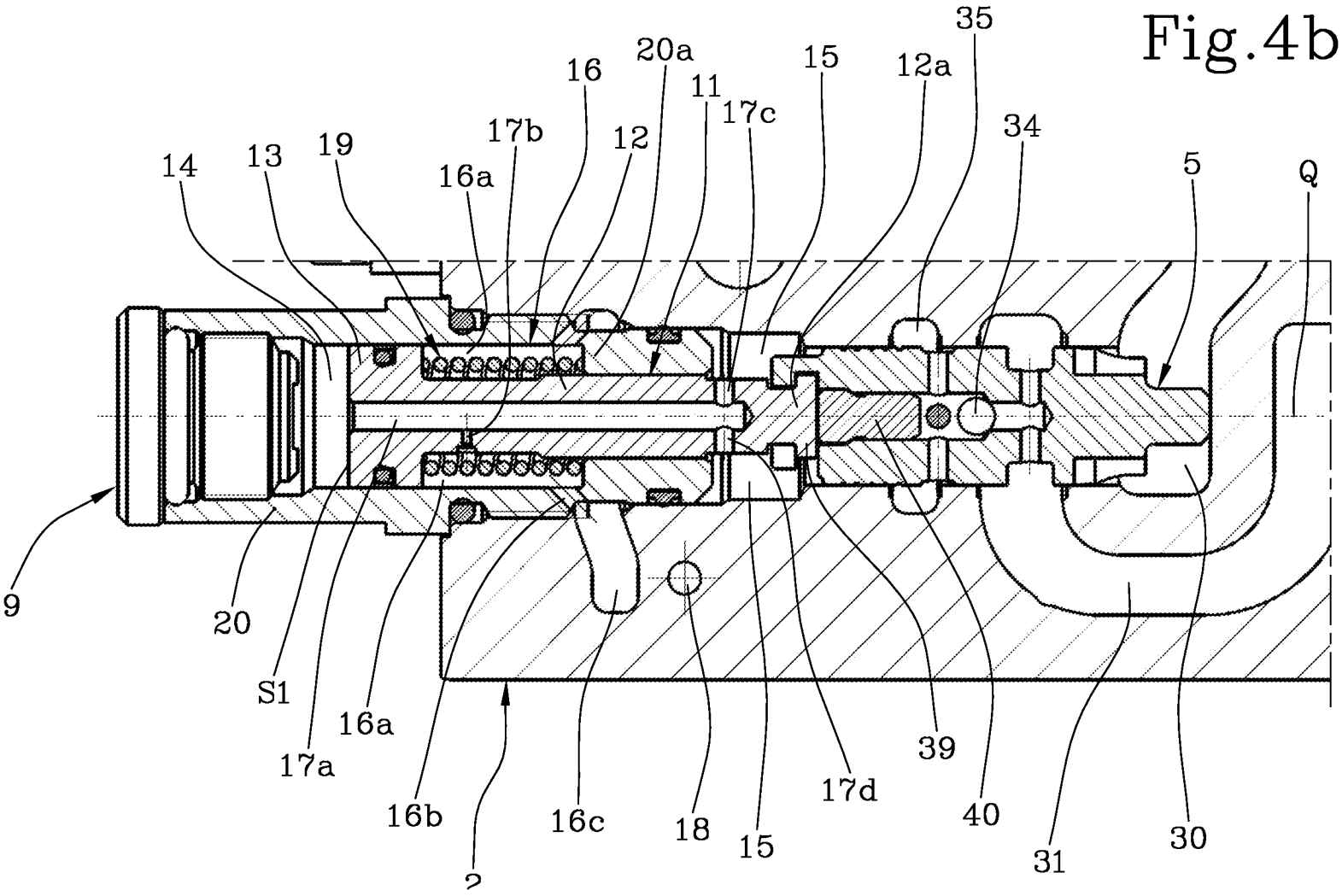

FIG. 4*b* illustrates the situation in which the piston 11 is found in the active configuration and the compensator 5 is forced in the closing direction.

The characteristics of the hydraulic section for load sensing applications and of the multiple hydraulic distributor, according to the present invention, clearly emerge from the description provided, as do the advantages thereof.

In particular, the inhibition of a service line and the limiting of pressure are obtained in a manner that is compact and structurally simple by means of a "differential" piston, which when suitably piloted, mechanically closes the local compensator. In particular, this solution is based on alteration of the balance of pressures on the active areas of the differential piston located between the plug and the compensator.

The differential intermediate chamber thus structured allows for a structural design featuring a non-dissipative architecture.

Given that the means for controlling the pressure act upon an active area of the piston, rather than on the compensator, perturbative effects on the compensator are prevented when the control means are disabled, thus resulting in a more stable hydraulic section.

Furthermore, the proposed structural design makes it possible to limit the pressure locally with minimum dissipation of energy, making a greater flow rate available for the other service lines.

In other words, the energy saved is used to increase the output of the other service lines and thus of the distributor.

Moreover, in the flow-sharing hydraulic section, owing to the fact that the retaining means and the compensator face each other, but are housed in separate holes in the valve body, access to these components is simplified, as is the structure thereof.

Furthermore, by entrusting the control of the highest pressure to the pilot stage adjusted on the basis of the pressure of the first distributor bridge, the workports can be controlled differentially, as is required in some applications.

Owing to the fact that the same common lines pass through all the sections and that the system controlling the piston can be used on any type of compensator, the same hydraulic section can be used for the flow-sharing function and the priority function, by simply substituting part of the components (for example the second spring or the connections between the piston and the compensator), leaving the housings unchanged and enabling/disabling some paths of the fluid through the lining.

The proposed hydraulic section is thus extremely versatile.

The invention claimed is:

1. Hydraulic section (1) for use in a hydraulic distributor (10), comprising:

a valve body (2);

a main spool (3) that is longitudinally slidable within said valve body (2) for selectively transmitting pressurised hydraulic fluid coming from a feed line (Pal) of a pump (100) to workports (A, B) through a metering orifice (4);

pressure compensation means (5) situated downstream of said main spool (3) with respect to the path of the fluid;

a first hole obtained in said valve body (2), said first hole housing the pressure compensation means (5);

a piston (11) housed in said first hole, characterised in that it comprises:

an intermediate chamber (16) extending at least partially in said first hole and being delimited by the rod (12) of the piston (11), said intermediate chamber (16) being in fluid communication with the feed line (Pal);

control means (6, 7) that are operatively active on said intermediate chamber (16) for altering the pressure thereof in such a manner that the piston (11) forces said compensation means (5) to shift from a first configuration, in which the passage of fluid is enabled and a substantially constant pressure drop is maintained through said metering orifice (4), to a second configuration, in which this passage of fluid is interrupted or limited; wherein, with the compensation means (5) in the first configuration, the pressure in said intermediate chamber (16) is equal to the pressure of the feed line (Pal) and, with said compensation means (5) in the second configuration, the pressure in the intermediate chamber (16) is lower than the pressure of the feed line (Pal).

2. Hydraulic section (1) according to claim 1, wherein said control means (6, 7) comprise two limiters, the hydraulic section (1) also comprising a drainage channel (18) outflowinq from said intermediate chamber (16).

3. Hydraulic section (1) according to claim 1, further comprising a liner (20) situated in said first hole and at least partially enclosing said piston (11), said intermediate chamber (16) comprising:

a first zone (16*a*) obtained between the rod (12) of the piston (11) and said liner (20);

a second zone (16*b*) obtained in the liner (20);

a third zone (16*c*) obtained in the valve body (2).

4. Hydraulic section (1) according to claim 3, further comprising:

a closure plug (9) for closing the liner (20);

a rear chamber (14) defined between the closure plug (9), a base (13) of the piston (11) and said liner (20);

a front chamber (15) defined between the compensation means (5), the head (12*a*) of said piston (11) and said liner (20);

a passage (17) for fluid afforded in the rod (12) of the piston (11), said passage (17) for fluid setting the intermediate chamber (16) in communication with the rear chamber (14).

5. Hydraulic section (1) according to claim 4, wherein said passage (17) for fluid comprises a first portion (17*a*) that is substantially longitudinal in extension within the rod (12) of said piston (11) and open on the base (13) of the piston (11), and a second portion (17*b*) that branches off from said first portion (17*a*) and leads into the intermediate chamber (16).

6. Hydraulic section (1) according to claim 5, wherein said second portion (17*b*) is shaped and dimensioned so as to constitute a throttle.

7. Hydraulic section (1) according to claim 5, wherein said passage (17) for fluid comprises two further portions (17*c*, 17*d*) pertaining to said first portion (17*a*) for receiving fluid from the feed line (Pal).

8. Hydraulic section (1) according to claim 1, further comprising a first spring (19) housed in said intermediate chamber (16).

9. Hydraulic section (1) according to claim 4, wherein said hydraulic section (1) is of the flow-sharing type and between said compensation means (5) and said piston (11) is placed a second spring (33) that is housed in the front chamber (15).

10. Hydraulic section (1) according to claim 9, further comprising:

retaining means (8);

a second hole obtained in said valve body (2), said second hole housing the retaining means (8).

11. Hydraulic section (1) according to claim 10, wherein said second hole is facing said first hole and is distinct therefrom.

12. Hydraulic section (1) according to claim 1, wherein said hydraulic section (1) is of the priority type and wherein said compensation means (5) are mechanically connected to said piston (11) by means of a mechanical interlocking element (39).

* * * * *